US008899066B2

(12) United States Patent
Mahajan

(10) Patent No.: US 8,899,066 B2
(45) Date of Patent: Dec. 2, 2014

(54) SYSTEM FOR ENVIRONMENTAL PROTECTION OF A HEAT EXCHANGER

(75) Inventor: Sachin Vitthal Mahajan, Hyderabad (IN)

(73) Assignee: General Electric Company, Schenectady, NY (US)

( * ) Notice: Subject to any disclaimer, the term of this patent is extended or adjusted under 35 U.S.C. 154(b) by 132 days.

(21) Appl. No.: 13/227,443

(22) Filed: Sep. 7, 2011

(65) Prior Publication Data

US 2013/0055748 A1 Mar. 7, 2013

(51) Int. Cl.

| | |
|---|---|
| ***F25D 17/04*** | (2006.01) |
| ***F04D 25/14*** | (2006.01) |
| ***F24F 1/00*** | (2011.01) |
| ***F04D 29/70*** | (2006.01) |
| ***F24F 13/14*** | (2006.01) |
| ***F04D 29/58*** | (2006.01) |

(52) U.S. Cl.

CPC ..... *F24F 1/0011* (2013.01); *F04D 25/14* (2013.01); *F24F 1/0059* (2013.01); *F04D 29/703* (2013.01); *F24F 13/14* (2013.01); *F04D 29/582* (2013.01)

USPC ..... 62/408

(58) Field of Classification Search

USPC ..... 62/262, 408, 412, 419

See application file for complete search history.

(56) References Cited

U.S. PATENT DOCUMENTS

| | | | | |
|---|---|---|---|---|
| 2,438,120 | A * | 3/1948 | Freygang | 62/173 |
| 2,987,894 | A * | 6/1961 | Lancaster | 62/97 |
| 3,759,056 | A | 9/1973 | Graber | |
| 6,164,082 | A | 12/2000 | Okamoto et al. | |
| 6,186,158 | B1 | 2/2001 | Goarin | |
| 6,338,382 | B1 * | 1/2002 | Takahashi et al. | 165/96 |
| 6,708,514 | B1 | 3/2004 | Miller | |
| 6,887,149 | B2 * | 5/2005 | Palmer et al. | 454/284 |
| 2008/0083239 | A1 | 4/2008 | Meyer | |
| 2010/0071877 | A1 | 3/2010 | Goel | |

FOREIGN PATENT DOCUMENTS

| | | | |
|---|---|---|---|
| EP | 0821203 | B1 | 6/2001 |
| WO | 03069233 | A1 | 8/2003 |
| WO | 2009028634 | A1 | 5/2009 |

OTHER PUBLICATIONS

Nu-Cagon, "Clean Coil Program:" http://www.nucalgon.com/assets/prodlit/3-116.pdf; 4 pages (last viewed Sep. 7, 2011).

Siegel, J., et al. "Dirty Air Conditioners: Energy Implications of Coil Fouling:" http://www.epd.lbl.gov/Publications/lbnl-49757.pdf; 12 pages (last viewed Sep. 7, 2011).

Sida; "Refrigeration & Air Conditioning" Presentation from the Energy Efficiency Guide for Industry in Asia; 50 pages; UNEP 2006.

* cited by examiner

*Primary Examiner* — Melvin Jones

(74) *Attorney, Agent, or Firm* — Fletcher Yoder P.C.

(57) ABSTRACT

In a one embodiment, a system includes an air conditioning unit having an enclosure, a heat exchanger disposed in the enclosure, and a plurality of louvers coupled to the enclosure. The plurality of louvers is configured to move between an open position and a closed position, and the closed position is configured to protect the heat exchanger from an environment external to the enclosure.

23 Claims, 7 Drawing Sheets

SYSTEM FOR ENVIRONMENTAL PROTECTION OF A HEAT EXCHANGER

BACKGROUND OF THE INVENTION

The subject matter disclosed herein relates to the protection of heat exchangers, such as air conditioner (AC) heat exchangers, from environmental debris.

A heat exchanger is a device that is used to transfer heat from one medium to another. For many heat exchanging systems, air serves as the target medium to which heat is transferred from some other hot medium (e.g., hot refrigerant, hot water, steam, etc.). In such systems, the hot medium is typically passed through one or more metallic coils that maximize the contact surface area for the heat exchanging process. Meanwhile, streams of relatively cool air are drawn over the coils, warming the air while cooling the coils and the medium contained therein. Ideally, the surface of the coils should remain free from environmental debris (e.g., dust, dirt, pollen, etc.), since this debris can reduce the contact surface area between the air stream and the coils. For example, the debris essentially creates an undesirable insulation layer (e.g., coil fouling) that can interfere with the heat transfer process. As the efficiency of the heat transfer process begins to decline due to this coil fouling, the efficiency of the entire system is reduced, and as a consequence, the power consumption of the system increases in an attempt to maintain a similar rate of heat transfer. Over time, system components, such as the compressor, may eventually be stressed to the point of failure in attempting to compensate for the lower efficiency. The problem of coil fouling is further exacerbated in refrigerant-based air conditioning systems, wherein the condenser coils are designed to be located in, and exchange air with, the relatively dirty outdoor environment.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes an air conditioning unit having an enclosure, a heat exchanger disposed in the enclosure, and a plurality of louvers coupled to the enclosure. The plurality of louvers is configured to move between an open position and a closed position, and the closed position is configured to protect the heat exchanger from an environment external to the enclosure.

In a second embodiment, a system includes a heat transfer unit with an enclosure having an air intake and an air exhaust, a heat exchanger disposed in the enclosure, a fan configured to direct air flow across the heat exchanger, and a plurality of louvers coupled to the air intake of the enclosure. The plurality of louvers is configured to move from a closed intake position to an open intake position in response to the air flow.

In a third embodiment, a system includes a heat transfer unit with an enclosure having an air intake and an air exhaust, a heat exchanger disposed in the enclosure, and a plurality of intake louvers coupled to the air intake. The heat transfer unit also includes at least one drive coupled to the plurality of intake louvers. The heat transfer unit also includes a controller coupled to the at least one drive, wherein the controller is configured to actuate the at least one drive to move the plurality of intake louvers between a closed intake and an open intake position, based on an operational state of the heat transfer unit.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments describe a method of sealing the enclosure of a heat transfer or heat exchanging unit (e.g., a central air conditioning unit or a window air conditioning unit) using a plurality of louvers. For example, certain disclosed embodiments may include an intake louver assembly, an exhaust louver assembly, or both. In each of the embodiments, the louvers are configured to close when the heat exchanging unit is inactive in order to seal the enclosure and sequester the enclosed heat exchanger from the environment outside of the enclosure. Certain disclosed implementations may include mechanisms for actively controlling the louver assemblies (e.g., drives, transfer linkages, belts), while others may employ passive control mechanisms in which the louvers may automatically close due to gravity or a spring force in the absence of an air flow through the heat exchanging unit enclosure.

Figure 1:
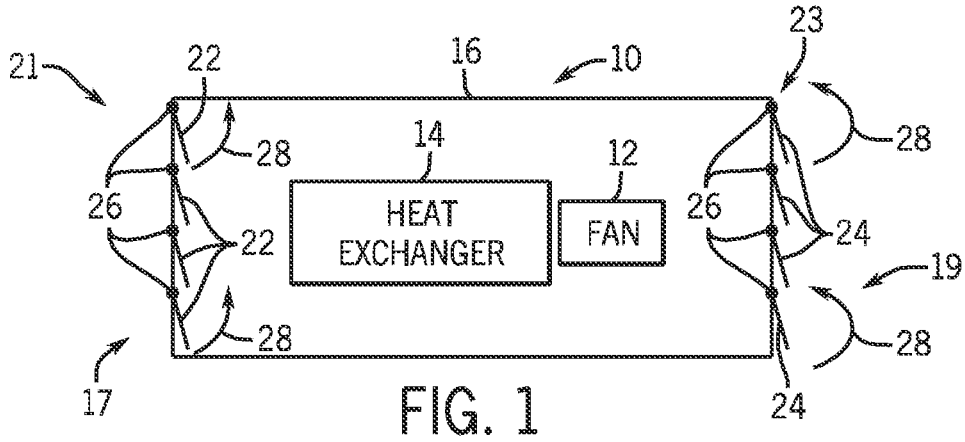
FIG. 1 is a schematic of an embodiment of a heat exchanging unit in an inactive state with intake and exhaust louvers in closed positions.

FIG. 1 is a schematic of an embodiment of a heat exchanging or heat transfer unit 10. In the depicted embodiment, unit 10 includes a fan 12 and a heat exchanger 14 located within an enclosure 16 having an air intake 18 and an air exhaust 20. The heat exchanger 14 (e.g., the evaporator or condenser of an air conditioning system) may include a plurality of coils housing a refrigerant path. The unit 10 includes a plurality of intake louvers 22 (e.g., intake louver assembly 17) attached to the intake 18 of the enclosure 16, and includes a plurality of exhaust louvers 24 (e.g., exhaust louver assembly 19) attached to the exhaust 20 of the enclosure 16. As illustrated, the intake and exhaust louver assemblies 17 and 19 have louvers 22 and 24 in respective closed intake and exhaust positions 21 and 23. In one embodiment, the intake louvers 22 or the exhaust louvers 24 are designed to be completely contained within the enclosure 16, while other embodiments may include intake louvers 22 or exhaust louvers 24 that are partially or completely disposed on the outside of the enclosure 16. In some embodiments, the intake louvers 22 or exhaust louvers 24 may include a rotational shaft 26, disposed through the length of the louver near the edge or the center of each louver 22 or 24, about which each louver partially rotates 28. Additionally, some embodiments may include a plurality intake louvers 22 or exhaust louvers 24 having shafts oriented horizontally or vertically.

The depicted embodiment illustrates an inactive unit (i.e. the fan 12 and heat exchanger 14 are not operational) and accordingly the intake louvers 22 and exhaust louvers 24 are in the closed positions 21 and 23 to block debris in the surrounding environment from entering the enclosure 16 to contaminate (i.e. foul) the surface of the heat exchanger 14. In one embodiment, the intake louvers 22 and exhaust louvers 24 are configured to close in the absence of an air flow as a result a force applied by gravity. Accordingly, the louvers 22 and 24 may be made of a lightweight material, such as plastic. Thus, the air flow may automatically open the louvers 22 and 24, while gravity automatically closes the louvers 22 and 24. In another embodiment, the intake 22 and exhaust 24 louvers remain closed in the absence of an air flow as a result of a closing (e.g., restoration) force applied by a spring, an elastic band, or the like, disposed about the shaft 26 of each louver. For example, the spring may be compressed or extended into a higher energy state as the air flow forces the opening of the louvers 22 or 24, such that the spring biases the louvers 22 or 24 toward closed positions as the air flow drops below a threshold.

Figure 2:
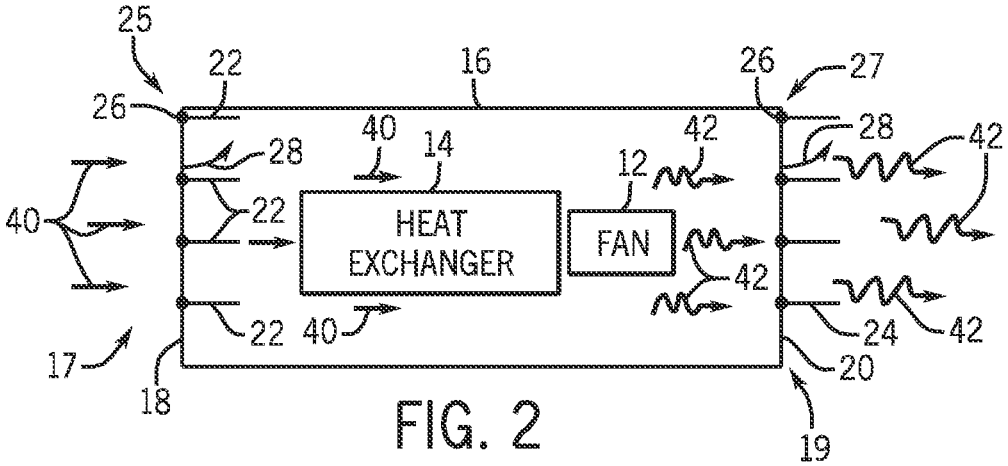
FIG. 2 is a schematic of an embodiment of the heat exchanging unit of FIG. 1 in an active state with intake and exhaust louvers in open positions.

FIG. 2 is a schematic of an embodiment of the heat exchanging unit 10 of FIG. 1, illustrating the louvers 22 and 24 in open positions 25 and 27 during operation of the unit 10. As illustrated, both the heat exchanger 14 and the fan 12 are active. Accordingly, the plurality of intake louvers 22 positioned over the intake 18 of the enclosure 16 and the plurality of exhaust louvers 24 positioned over the exhaust 20 of the enclosure 16 have been rotated 28 about their respective shafts 26 to the open positions 25 and 27. The illustrated embodiment depicts streams of relatively cool air 40 entering the enclosure 16 through the open intake louvers 22, passing over and cooling the heat exchanger 14, and exiting the enclosure 16 as warm air 42 through the action of the fan 12. In one embodiment, during operation of the heat exchanging unit 10, the intake louvers 22 remain open in response to the applied force of the air flow 40, and, similarly, the exhaust louvers 24 remain open in response to the applied force of the air flow 42. In such an embodiment, the force applied to the surface of each intake louver 22 or exhaust louver 24 by the air flows 40 and 42 is sufficient to overcome the closing force applied to the louvers by gravity, a spring, an elastic band, or any combination thereof, putting the louvers 22 and 24 in higher positional potential energy states. As such, when the fan 12 is turned off and the force supplied to the surface of the intake and exhaust louvers 22 and 24 by the air flows 40 and 42 relents, a closing (i.e. restoration) force may be supplied by the particular closing mechanism (e.g., gravity, spring, etc.) employed to return both the intake and exhaust louvers 22 and 24 to their closed (e.g., lower potential energy) positions 21 and 23.

Figure 3:
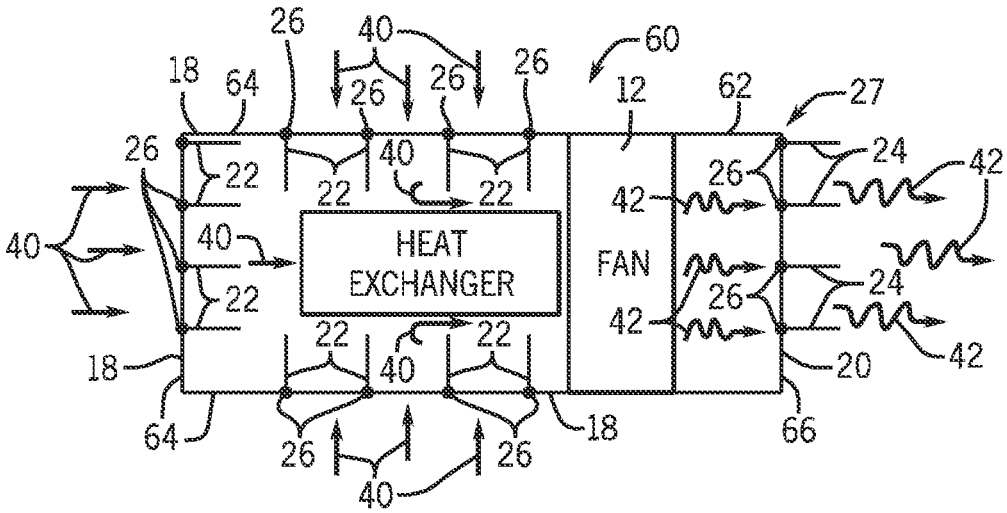
FIG. 3 is a schematic of an embodiment of a heat exchanging unit having multiple intake sides with intake louvers.

FIG. 3 is a schematic of an embodiment of an active heat exchanging unit 60 with multiple air intake sides and a single air exhaust side having louvers 22 or 24. Like the embodiments of FIGS. 1-2, the heat exchanging unit 60 includes a plurality of louvers that are configured to seal the unit 60 when it is inactive to protect it from the external environment. In such an embodiment, the heat exchanger 14 may be positioned centrally within an enclosure 62 between multiple intake faces 64 and an exhaust face 66. Each intake face 64 has an air intake 18 with an intake louver assembly 17, which includes a plurality of intake louvers 22 selectively movable between an open intake position 21 and a closed intake position 25. The exhaust face 66 has an air exhaust 20 with an exhaust louver assembly 19, which includes a plurality of exhaust louvers 24 selectively movable between an open exhaust position 23 and a closed exhaust position 27. In an active state of the unit 60, the fan 12, forces an air flow 40 through the enclosure 62 to cool the heat exchanger 14, and simultaneously forces the louvers 22 from the closed position 21 and 23 to the open positions 25 and 27. Furthermore, the fan 12 is positioned between the intake faces 64 and the exhaust face 66, thereby forcing the air flow 40 through the heat exchanger 14 prior to exiting the enclosure 62 as the warmed air flow 42. In some embodiments, the exhaust face 66 may be on the top side of the enclosure 62 to direct the warmed air flow 42 vertically upward, taking advantage of the rising action of the lower-density, warm air 42 to further encourage air flows 40 and 42 through the enclosure 62.

Figure 4:
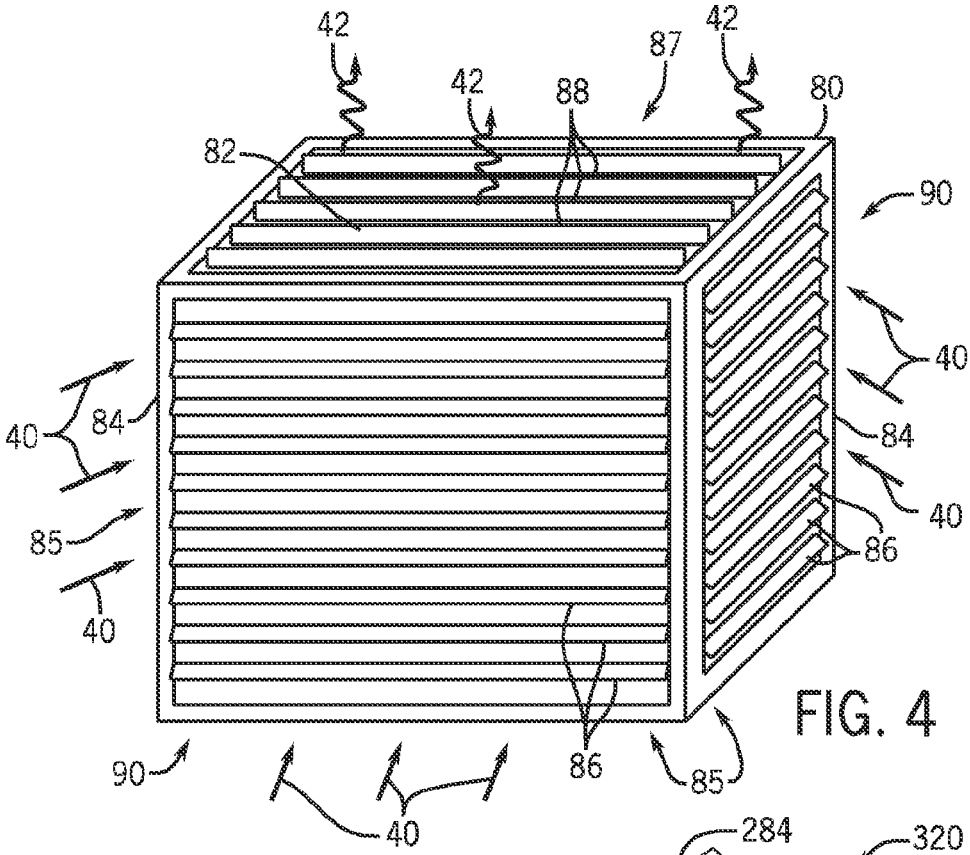
FIG. 4 is a perspective view of an embodiment the active heat exchanging unit of FIG. 3.

FIG. 4 is a perspective view of an embodiment of the heat exchanging unit 60, illustrating louver assemblies on multiple faces of an enclosure 80 (e.g., a cubic enclosure) that are configured to sequester the internal components of the heat exchanging unit 60 (e.g., heat exchanger 14 and fan 12) from the external environment when the unit 60 is inactive. In the illustrated embodiment, the unit 60 has an upper exhaust face 82, and lateral intake faces 84 within the enclosure 80, the unit 60 includes the heat exchanger 14 and fan 12 in an active state. Furthermore, each intake face 84 has a plurality of intake louvers 86 (e.g., intake louver assembly 85), while the exhaust face 82 has a plurality of exhaust louvers 88 (e.g., exhaust louver assembly 87). The louvers 86 and 88 are all disposed in open positions 90 and 92 to enable air flows 40 and 42. Thus, the heat exchanging unit 60 has streams of relatively cool air 40 entering the enclosure 80 through the open intake louvers 86 on the various intake faces 84 of the enclosure 80, passing over and cooling the enclosed heat exchanger 14, and exiting from the top of the enclosure 80 as warm air 42. In another embodiment, the heat exchanging unit 60 may not include a fan and may instead be placed in the path of an air flow produced by another system in order to cool the enclosed heat exchanger 14.

Figure 5:
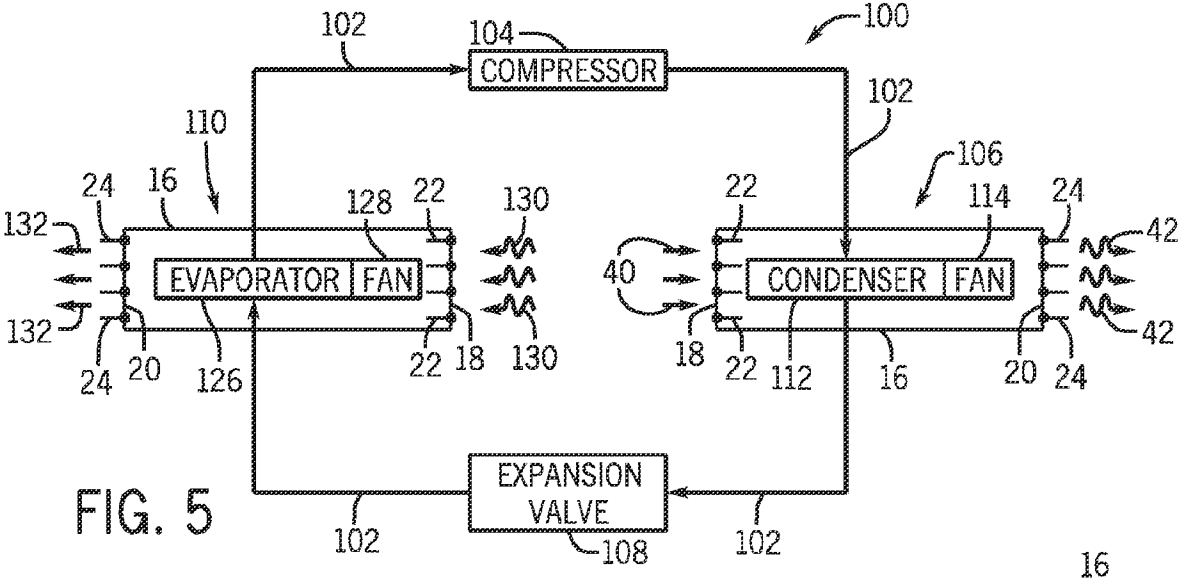
FIG. 5 illustrates a block diagram of an embodiment of a vapor compression refrigeration air conditioning system.

FIG. 5 illustrates a block diagram of a vapor compression refrigeration air conditioning system 100, wherein a refrigerant is cycled between its vapor and liquid phases through a refrigerant path 102 to affect a transfer of heat from the air inside of a building to the air outside of the building. The depicted embodiment includes the refrigerant path 102 connecting a compressor 104, an outdoor condenser unit 106, an expansion valve 108, and an indoor evaporator unit 110. The depicted condenser unit 106 and evaporator unit 110 include respective heat exchangers (i.e. condenser 112 and evaporator 126,) and fans (i.e. fans 114 and 128) disposed inside of respective enclosures 16, as discussed above with reference to FIGS. 1 and 2. Accordingly, each enclosure 16 has an intake 18 with a plurality of intake louvers 22, as well as an exhaust 20 having a plurality of exhaust louvers 24, that may close when the system 100 is inactive in order to reduce coil fouling in the heat exchangers 14 due to environmental debris.

In the illustrated embodiment, a gaseous refrigerant passes through the compressor 104, which increases the pressure of the gas in the refrigerant path 102 that leads to the condenser unit 106. In the condenser unit 106, the refrigerant passes through a plurality of coils in the condenser 112, wherein the refrigerant is cooled by the air outside of the building by the action of the fan 114 and condenses to a liquid. Then, as the liquid refrigerant traverses the next leg of the refrigerant path 102 to reach the expansion valve 108, it experiences a rapid drop in pressure resulting in a portion of the refrigerant returning to gaseous form. Next, the liquid and gaseous refrigerant mixture travels the refrigerant path 102 to the evaporation unit 110. In the evaporation unit 110, the refrigerant passes through a plurality of coils in the evaporator 126, wherein the refrigerant is heated by air 130 inside the building through the action of the fan 128, evaporating the refrigerant to a gas while producing streams of cool air 132 inside the building. The gaseous refrigerant then returns to the compressor 104 along the refrigerant path 102 to complete the cycle.

In such an embodiment, the intake louvers 22 attached to the enclosure 16 of the condenser unit 106 may move from the closed intake position 21 to the depicted open intake position 25 during operation of the air conditioning system 110 to enable relatively cooler air 40 from outside of the enclosure 16 to enter through the intake louvers 22. Similarly, exhaust louvers 24 attached to the enclosure 16 of the condenser unit 106 may move from the closed exhaust position 23 to the depicted open exhaust position 27 to enable warm air 42 to exit the exhaust 20 of the enclosure 16 through the exhaust louvers 24. In one embodiment, the intake and exhaust louvers 22 and 24 may move to the closed positions 21 and 23 during system inactivity to limit exposure of the coils of the condenser 112 to environmental debris. In an embodiment, only intake louvers 22 are employed on the condenser unit 106 and the exhaust 20 of the enclosure 16 remains unobstructed when the air conditioning system 100 is inactive. In another embodiment, only exhaust louvers 24 are included on the condenser unit 106 and the intake 18 of the enclosure 16 remains unobstructed when the air conditioning system 100 is inactive.

Similarly, in the illustrated embodiment, the intake louvers 22 attached to the enclosure 16 of the evaporator unit 106 may move from the closed intake position 21 to the depicted open intake position 25 during operation of the air conditioning system 110 to enable relatively warm air 130 from outside of the enclosure 16 to enter through the intake louvers 22. The exhaust louvers 24 attached to the enclosure 16 of the evaporator unit 106 may move from the closed exhaust position 23 to the depicted open exhaust position 27 to enable cool air 132 to exit the exhaust 20 of the enclosure 16 through the exhaust louvers 24. In one embodiment, the intake and exhaust louvers 22 and 24 may move to the closed positions 21 and 23 during system inactivity to limit exposure of the coils of the evaporator 126 to environmental debris. In an embodiment, only intake louvers 22 are employed and the exhaust 20 of the enclosure 16 of the evaporator unit 110 remains unobstructed when the air conditioning system 100 is inactive. In another embodiment, only exhaust louvers 24 are included on the evaporator unit 110 and the intake 18 of the enclosure 16 remains unobstructed when the air conditioning system 100 is inactive.

Figure 6:
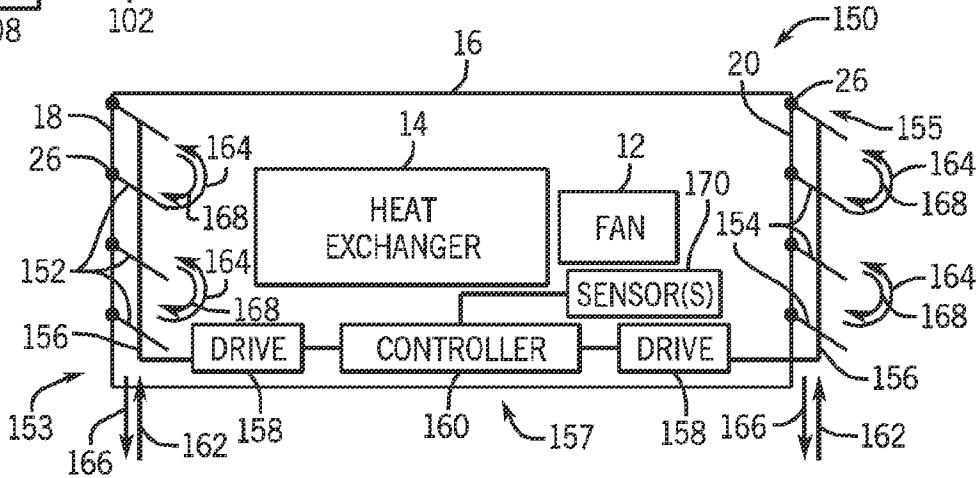
FIG. 6 is a schematic of an embodiment of a heat exchanging unit with the louvers coupled to drives that are controlled by a controller.

FIG. 6 is a schematic of an embodiment of a heat exchanging unit 150 with an active louver control system 157. As illustrated, the unit 150 includes a heat exchanger 14 and fan 12 within an enclosure 16 having an intake 18 and an exhaust 20. In such an embodiment, the intake 18 may include a plurality of intake louvers 152 (e.g., intake louver assembly 153) and exhaust 20 may have a plurality of exhaust louvers 154 (e.g., exhaust louver assembly 155) that close to protect the heat exchanger 14 from environmental debris when the heat exchanging unit 150 is not active. Each intake louver 152 and exhaust louver 154 may be attached to the enclosure 16 using a rotational shaft 26 about which the louver may rotate. In the illustrated embodiment, the active louver control system 151 includes linkages or rods 156, drives 158, and controller 160 to control operation of the louvers 152 and 154. The intake louvers 152 and the exhaust louvers 154 may be attached to one or more transfer linkages or rods 156, which may be manipulated by one or more drives 158 based upon signals from the controller 160.

In the depicted embodiment, the heat exchanging unit 150 is preparing to activate the heat exchanger 14 and fan 12, and accordingly, the controller 160 first activates the drives 158 to impart an upward thrusting motion 162 to the transfer rods 156 of both the intake louvers 152 and the exhaust louvers 154. The upward thrusting motion 162 to the transfer rods 156 causes the attached intake louvers 152 and exhaust louvers 154 to rotate 164 about their respective shafts 26 from a closed position to an open position. In one embodiment, the drives 158 may be one or more of an electric, pneumatic, hydraulic, or similar drive, and may be powered by a power supply within the heat exchanging unit 150, a battery, a solar panel, or the like. In one embodiment, the intake louvers 152 and exhaust louvers 154 may be closed by the drives 158 via a downward pulling motion 166 to the transfer rods 156 based upon a signal from the controller 160 when the heat exchanging unit 150 is inactive. This downward pulling motion 166 causes the intake louvers 152 and the exhaust louvers 154 to rotate 168 about their respective shafts 26 to a closed position. In one embodiment, the controller 160 may determine the operational state of the heat exchanging unit 150 based on temperature feedback, air flow feedback, a control signal, a thermostat signal, or the like, using sensors 170 coupled to the controller 160 and distributed throughout the enclosure 16. In such embodiments, the controller 160 may include circuitry (e.g., microprocessor executing software or firmware, programmable logic controller (PLC), or other control circuitry)

to determine the operational state of the system 150 and position the intake 152 and exhaust 154 louvers accordingly.

Figure 7:
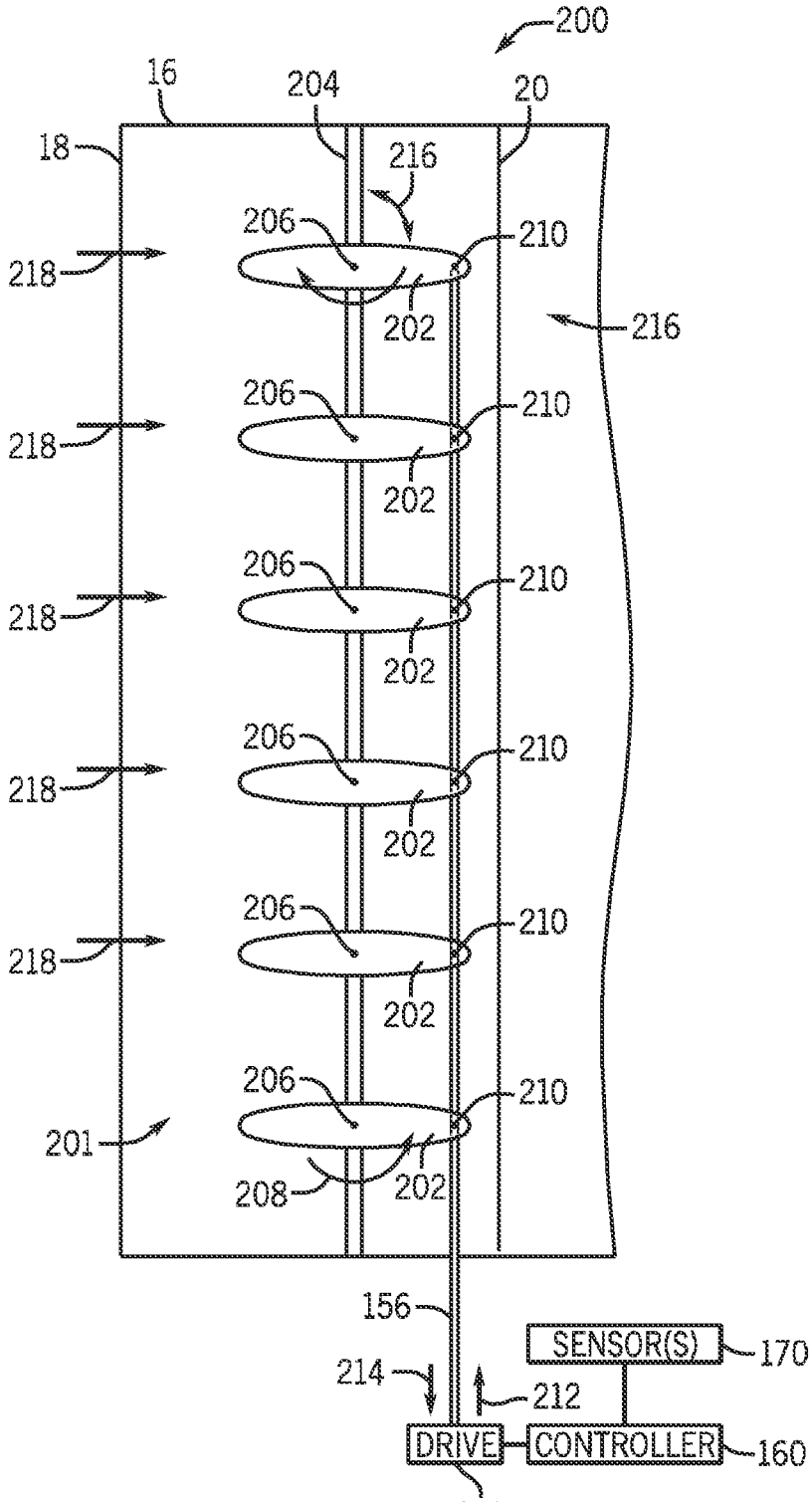
FIG. 7 is a schematic of an embodiment of a mechanism for opening and closing the louvers using a transfer rod, drive, and controller.

FIG. 7 is a schematic of an embodiment of an active control mechanism 200 for controlling a plurality of louvers 202 (e.g., a louver assembly 201). In the depicted embodiment, each louver 202 is attached to a support structure 204 with a rotational shaft 206. These shafts 206 extend out of the ends of each louver 202 into the support structure 204, so as to provide each louver 202 with an axis of rotation 208 about its respective shaft 206. In one embodiment, the louvers 202 are intake louvers, and therefore, the support structure 204 is attached to the enclosure 16 near an intake 18. In another embodiment, the louvers 202 are exhaust louvers, and therefore, the support structure 204 is instead attached to the enclosure 16 near an exhaust 20. In the illustrated embodiment, each of the louvers 202 has an edge or end portion 210 (e.g., a rotational joint offset from the rotational axis of the louver) attached to a common transfer linkage or rod 156 that interfaces with a drive 158 being controlled by a controller 160.

In operation, the controller 160 may actuate the drive 158, so as to provide a push 212 or pull 214 motion to the transfer rod 156, which transfers the push or pull force to the edge 210 of the louvers 202. In turn, the push 212 or pull 214 causes the louvers 202 to rotate 208 about their respective shafts 206. The depicted embodiment illustrates the louvers 202 in an open position 216, wherein the transfer rod 156 has been positioned by the drive 158 (based upon a signal from the controller 160), so that the louvers 202 are nearly perpendicular 216 to the support structure 204 and let maximum air flow 218 pass. In one embodiment, the controller 160 may include sensor circuitry configured to detect the position of the transfer rod 156 to determine the direction that the drive 158 is to move in order to adjust the louvers 202 into a particular position. In other embodiments, a stepper motor or other precision motor may be employed in the drive 158, and the controller 160 may cause the drive to perform a calibrated number of steps or rotations in a set direction for each open and close operation. In some embodiments, one or more sensors 170 may be incorporated into the controller 160 to determine the current air flow rate and properly adjust the position of the louvers 202. However, the controller 160 may also adjust the position of the louvers 202 based upon various temperatures within the enclosure 16, a control signal from a system controller or thermostat, or another input signal.

Figure 8:
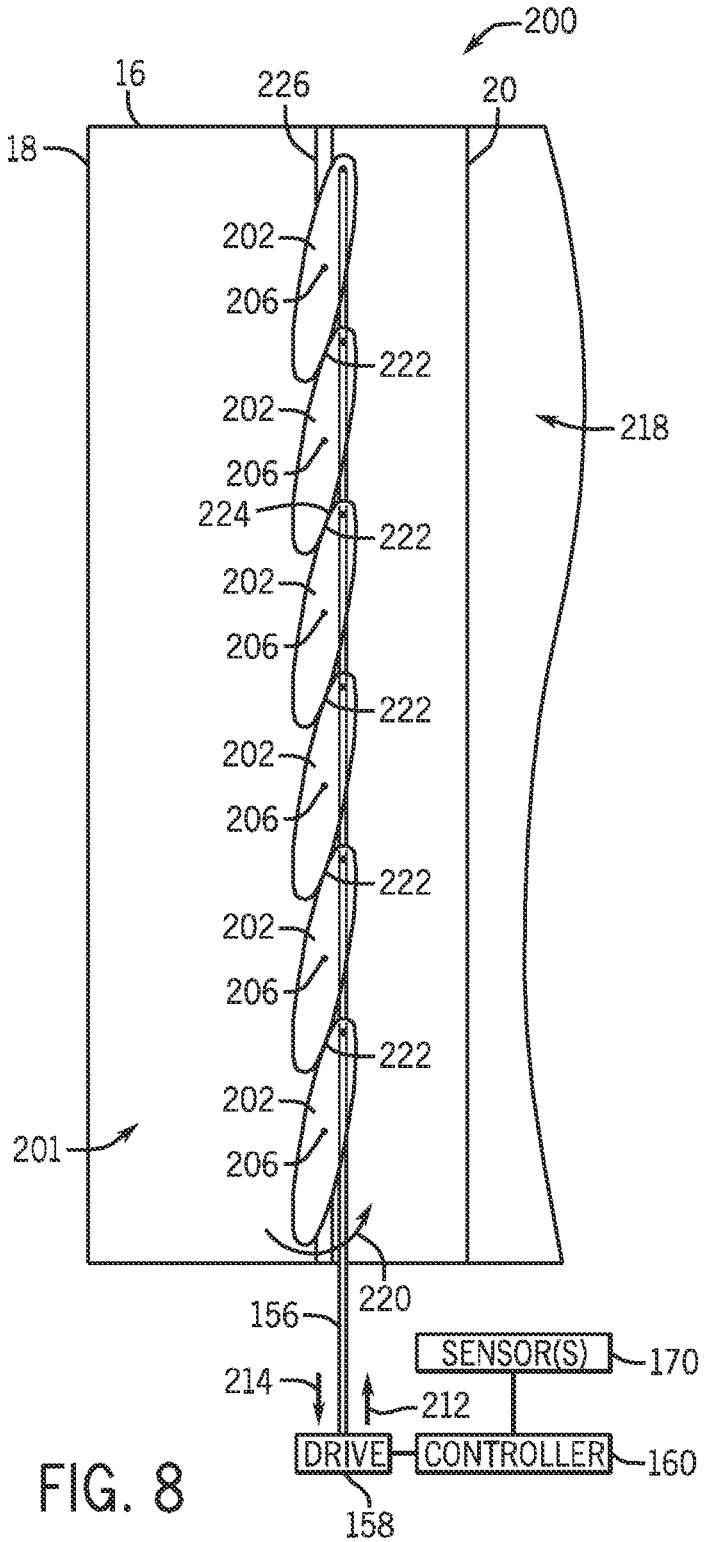
FIG. 8 is a schematic of the embodiment of FIG. 7, illustrating the louvers in the closed position.

FIG. 8 is a schematic of the embodiment of FIG. 7, illustrating the louvers 202 in a closed position 218. In the illustrated embodiment, the controller 160 has actuated the drive 158 such that the transfer rod 156 has been pushed up 212 by the drive 158 until the louvers 202 have rotated 220 about their respective shafts 206, thereby moving the louvers 202 to the closed position 218, in which the louvers 202 contact one another along intermediate interfaces 222. For example, each interface 222 may include one or more seals 224 to block the entry of debris. The seals 224 may include a fabric seal, an elastomer seal, or any other type of seal. In some embodiments, the louvers 202 may seal against the support structure 204. For example, a support seal 226 may extend around the perimeter of the louvers 202. In one embodiment, the interface 222 between each pair of adjacent louvers 202 may include a support bar separate from the louvers 202, wherein the support bar may include one or more seals. In each embodiment, the seals help to block the entry of debris, thereby helping to keep the heat exchanger 14 clean.

Figure 9:
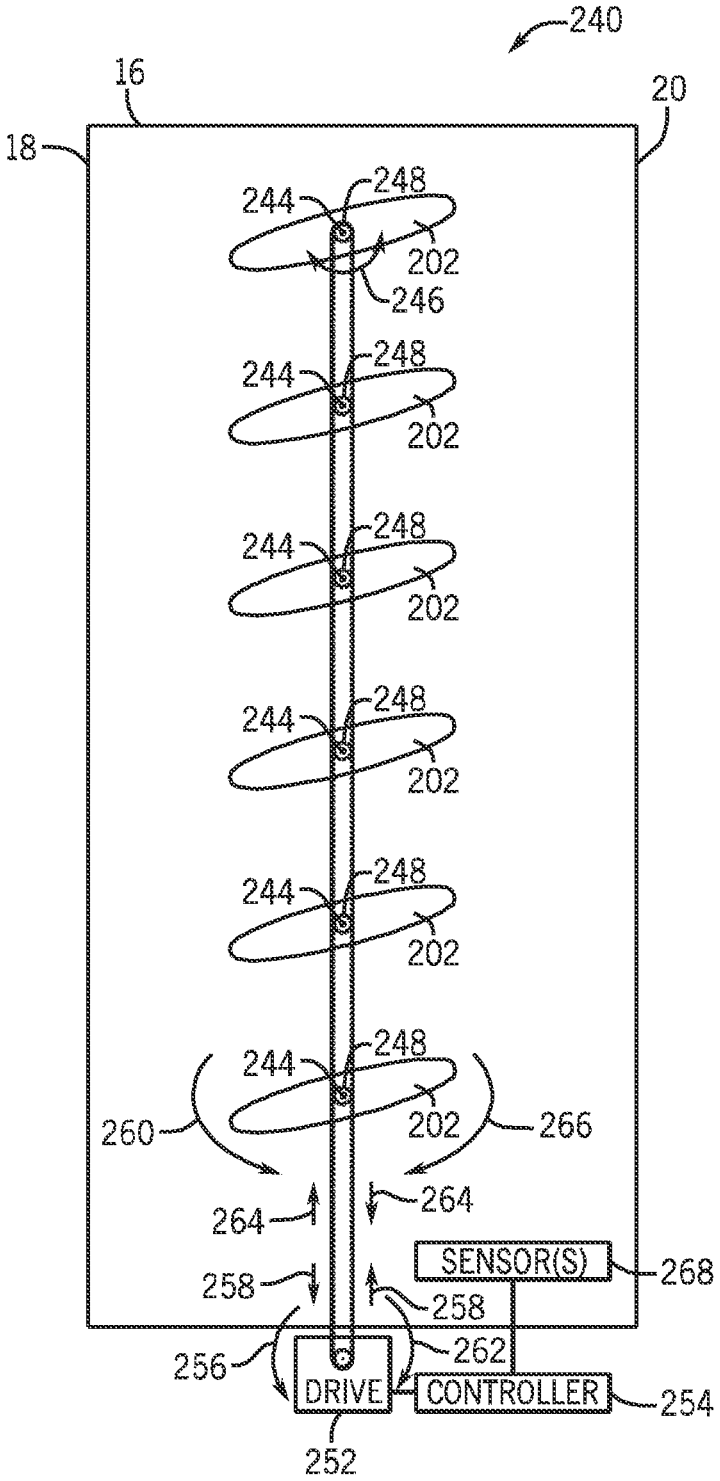
FIG. 9 is a schematic of an embodiment of a mechanism for opening and closing the louvers using a transmission mechanism, drive, and controller.

FIG. 9 is a schematic of an embodiment of an active control mechanism 240 for controlling the louvers 202. In the illustrated embodiment, a plurality of louvers 202 is attached to an enclosure 16 with a rotational shaft 244. These shafts 244 extend out of the ends of each louver 202 and into the opposite faces of the enclosure 16, so as to provide each louver 202 with an axis of rotation 246 about its respective shaft 244. In one embodiment, the louvers 202 are intake louvers and are attached to the enclosure 16 near an intake 18. In another embodiment, the louvers 202 are exhaust louvers and are attached to the enclosure 16 near an exhaust 20. In the depicted embodiment, each louver shaft 244 includes one or more pulleys or gears 248 connected to a common transmission mechanism 250, such as a belt, a chain, or another loop. In such an embodiment, the loop 250 may be driven by a drive 252 being actuated by a controller 254. In one embodiment, the drive 252 may be one or more of an electric, pneumatic, hydraulic, or similar drive, and may be powered by a power supply within the enclosure 242, a battery, a solar panel, or the like.

In operation, a signal from the controller 254 may actuate the drive 252 to cause a counter-clockwise motion 256 of the drive 252, which imparts a counter-clockwise motion 258 to the loop 250. In turn, the counter-clockwise motion 258 imparts a counter-clockwise motion 260 to each one of the louvers 202. Similarly, a signal from the controller 254 may actuate the drive 252 to cause a clockwise motion 262 of the drive 252, which imparts a clockwise motion 264 to the loop 250. In turn, the clockwise motion 264 imparts a clockwise motion 266 to the louvers 202. In certain embodiments, the clockwise or counter-clockwise motions may be used to move the louvers between open and closed positions. Furthermore, similar to the embodiments of FIGS. 7-8, the louvers 202 may be substantially sealed in the closed position to block entry of debris into the enclosure 16.

In one embodiment, the controller 254 may be equipped with internal or external sensors 268 configured detect the resistance of the louvers 202 to further rotation (e.g., indicative of the closed position) and respond by stopping the motion of the drive 252 accordingly. In some embodiments, one or more sensors 268 (e.g., flow sensors, temperature sensors, motion sensors, etc.) may be employed in order for the controller 254 to determine the open or closed state of the louvers 202 to achieve the target flow rate or temperature. In some embodiments, the controller 254 may rely upon some other feedback mechanism, such as a control signal, a thermostat signal, or the like, to determine the operational state of the system. In another embodiment, a stepper motor or similar precision motor may be employed in the drive 252 such that, after proper calibration, the controller 254 may move the drive a set number of steps or rotations in a set direction for every open and close operation.

Figure 10:
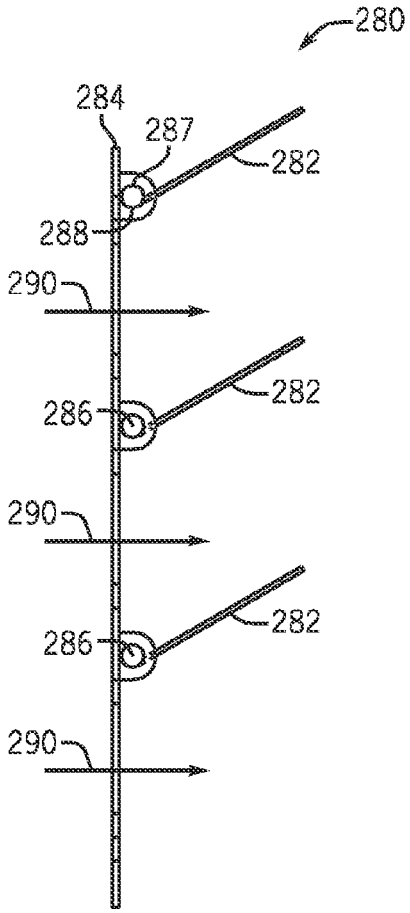
FIG. 10 is a side view of an embodiment of a louver assembly configured to mount to an enclosure having a heat exchanger.

FIG. 10 is a side view of an embodiment of a louver assembly 280 configured to mount to an enclosure and selectively cover and uncover a flow path (e.g., intake or exhaust), thereby blocking entry of debris during an inactive state of the heat exchanger and opening the flow path during an active state of the heat exchanger. In the illustrated embodiment, the assembly 280 has a plurality of louvers 282 attached to a panel or frame 284 with a plurality of rotational shafts 286 supporting the louvers 282. The shafts are connected to the frame 284 at protruding tabs or lips 287, which include openings 288, to support the shafts 286 at opposite ends. In the illustrated embodiment, the louver assembly 280 is a passive unit, which opens and closes the louvers 282 without any drive. For example, the louvers 282 automatically open in response to the presence of an air flow, which forces the louvers 282 to open when the system is active. In turn, gravity automatically closes the louvers 282 in response to an absence of an air flow 290, thereby closing the louvers 282 when the system is inactive. However, some embodiments of the louver assembly 280 may be spring assisted. For example, the shaft 286 may include a spring coupled to each louver 282, thereby biasing the louver 282 toward a closed position. Again, the presence of an air flow 290 may overcome the spring and gravity to open the louver 282, while the absence of the air flow 290 may result in the spring biasing the louver 282 to the closed position. The illustrated louver assembly 280 may be attached to the air intake 18 or air exhaust 20 of any enclosure as discussed above.

Figure 11:
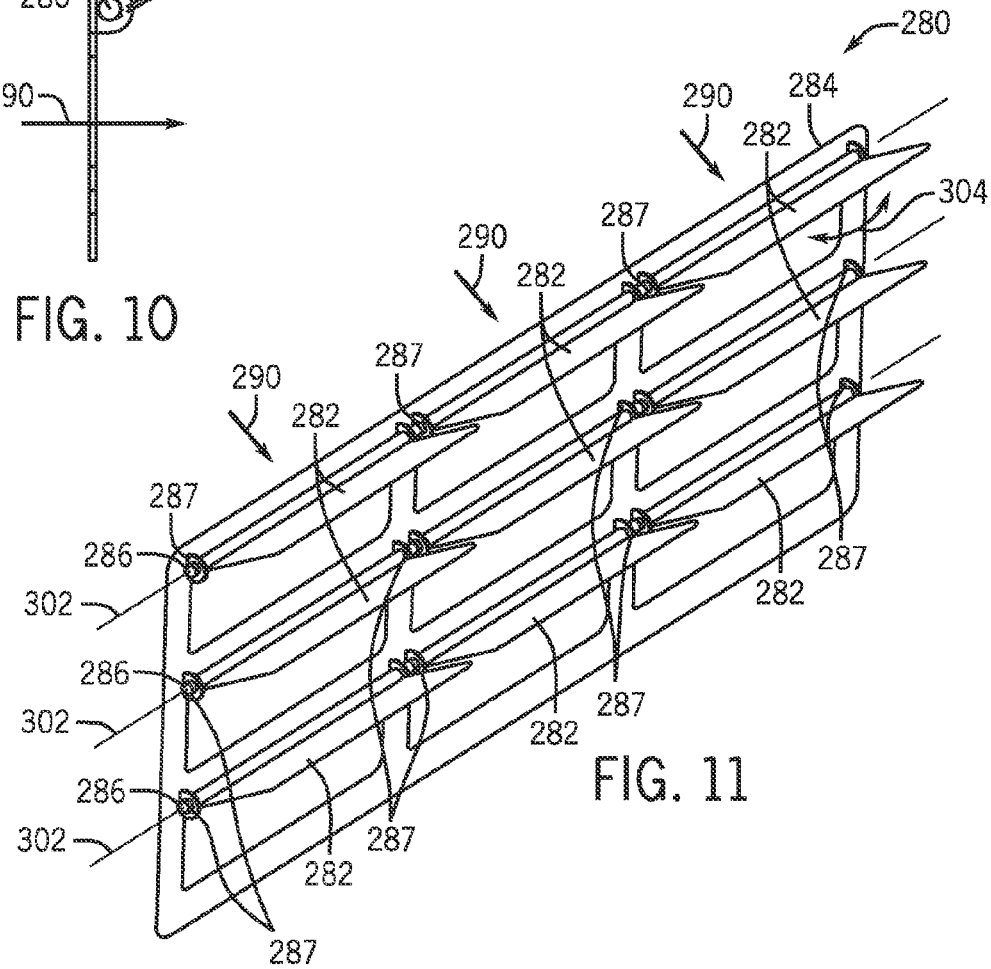
FIG. 11 is a perspective view an embodiment of the louver assembly of FIG. 10.

FIG. 11 is a perspective view of an embodiment of the louver assembly 280 of FIG. 10, illustrating details of the frame 284 and louvers 282. In the depicted embodiment, each louver 282 is attached to the frame 284 with a rotational shaft 286 supported by the tabs or lips 287. For example, each shaft 286 may be supported by lips 287 at four locations across the frame 284. Furthermore, each shaft 286 may support one or more louvers 282. In the illustrated embodiment, each shaft 286 supports three louvers 282, e.g., one louver between each pair of lips 287. In addition, the illustrated assembly 280 includes three rows 302 of louvers 282. However, the assembly 280 may include any number of louvers 282. As a result the louvers 282 in each row 302 are able to rotate 304 about their respective shafts 286. Again, as discussed above, the illustrated louver assembly 280 is a passively controlled system, which may rely entirely on gravity and air flow to control the opening and closing of the louvers 202.

Figure 12:
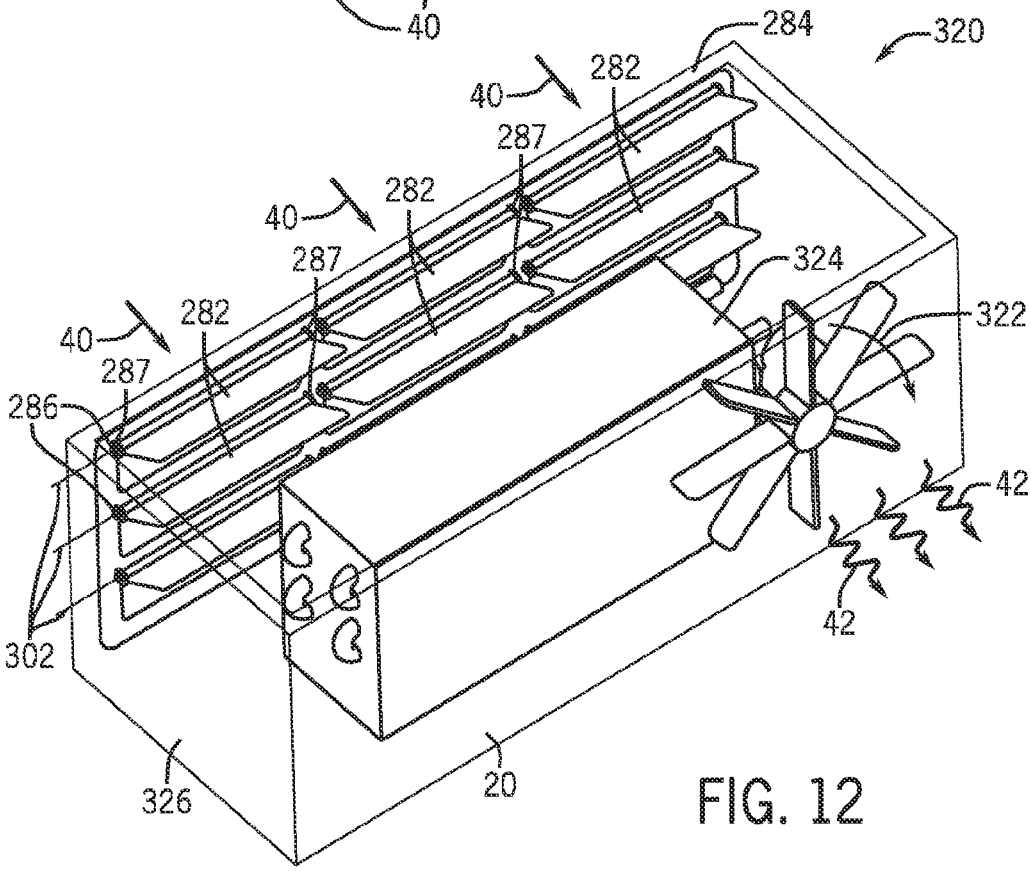
FIG. 12 is a perspective view of an embodiment of an active heat exchanging unit with the louver assembly of FIGS. 10-11.

FIG. 12 is a perspective view of an embodiment of a heat exchanging unit 320 having the louver assembly 280 of FIGS. 10-11. As illustrated, the unit 320 includes a fan 322 and a heat exchanger 324 disposed inside of an enclosure 326 having an intake 18 and an exhaust 20. The intake 18 of the enclosure 326 has a plurality of rows of louvers 302 (e.g., louvers 282) coupled to the frame 284. In the illustrated embodiment, the fan 322 is actively flowing cool air 40 into the enclosure 326 through the louvers 282, and is actively exhausting warm air 42 from the enclosure 326 downstream of the heat exchanger 324. As the air flows through the enclosure 326, the heat exchanger 324 cools an internal fluid flow (e.g., gas or liquid), thereby transferring heat to the cool air 40 to generate the warm air 42. During the presence of air flows 40 and 42 (e.g., active fan), the louvers 282 automatically open against the force of gravity (and optionally a spring). In the absence of air flows 40 and 42 (e.g., inactive fan) the louvers 282 automatically close via gravity (and optionally a spring). Accordingly, the louvers 282 block entry of debris while the fan 322 is inactive.

Technical effects of the invention include the ability to limit coil fouling with enclosed heat exchanging units by limiting the exposure of the heat exchanger to its surrounding environment when it is not actively in use. Through the use of a plurality of intake and/or exhaust louvers, the enclosure of heat exchanging units (e.g., central air conditioning units and window air conditioning units) may be effectively sealed when the unit is inactive to prevent the entry of environmental contaminants (e.g., pollen and dust) that may collect on surface of the heat exchanger and restrict the heat transfer process. Protecting the coils of the heat exchanger, as disclosed herein, helps to ensure that the heat exchanging unit will operate at a high efficiency, without unnecessary strain, and with lower maintenance costs (e.g., coil cleaning and failed part replacement). Thus, this invention further allows for an improvement in the efficiency, maintainability, and life expectancy of heat exchanging units.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

an air conditioning unit, comprising:

an enclosure;

a heat exchanger disposed in the enclosure; and a plurality of louvers coupled to the enclosure, wherein the plurality of louvers is configured to automatically move between an open position and a closed position based on an operational state of the air conditioning unit, and wherein the closed position is configured to isolate the heat exchanger from an environment external to the enclosure while the heat exchanger is not operating.

2. The system of claim 1, wherein the plurality of louvers is disposed over an air intake of the enclosure.

3. The system of claim 1, wherein the plurality of louvers is disposed over an air exhaust of the enclosure.

4. The system of claim 1, wherein the air conditioning unit comprises a fan configured to provide an air flow across the heat exchanger, and the plurality of louvers is configured to move from the closed position to the open position in response to the air flow.

5. The system of claim 4, wherein the plurality of louvers is configured to move from the open position to the closed position in response to an absence of the air flow.

6. The system of claim 1, wherein the air conditioning unit comprises a drive configured to move the plurality of louvers between the closed position and the open position.

7. The system of claim 6, wherein the air conditioning unit comprises a controller coupled to the drive, and the controller is configured to actuate the drive to move the plurality of louvers between the closed position and the open position based on the operational state of the air conditioning unit.

8. The system of claim 6, wherein the air conditioning unit comprises a transmission mechanism between the drive and the plurality of louvers, and the transmission mechanism is coupled to a rotational shaft of the plurality of louvers.

9. The system of claim 6, wherein the air conditioning unit comprises a transmission mechanism disposed between the drive and the plurality of louvers, and wherein the transmission mechanism is coupled to the plurality of louvers at an offset from a rotational axis of the plurality of louvers.

10. The system of claim 1, wherein the heat exchanger comprises a refrigerant path.

11. The system of claim 1, wherein the air conditioning unit comprises a window air conditioning unit or a condenser unit of a central air conditioning system.

12. A system, comprising:

a heat transfer unit, comprising:

an enclosure comprising an air intake and an air exhaust;

a heat exchanger disposed in the enclosure;

a fan configured to direct an air flow across the heat exchanger; and a plurality of louvers coupled to the enclosure, wherein the plurality of louvers is configured to move from an open position to a closed position in response to an absence of the air flow.

13. The system of claim 12, wherein the plurality of louvers comprises a plurality of intake louvers coupled to the air intake, wherein the plurality of intake louvers is configured to move from an open intake position to a closed intake position in response to the absence of the air flow.

14. The system of claim 12, wherein the plurality of louvers comprises a plurality of exhaust louvers coupled to the air exhaust, wherein the plurality of exhaust louvers is configured to move from an open exhaust position to a closed exhaust position in response to the absence of the air flow.

15. The system of claim 14, wherein the plurality of louvers is configured to move from the closed position to the open position in response to a presence of the air flow.

16. The system of claim 12, wherein the heat exchanger comprises an air conditioning heat exchanger having a refrigerant path.

17. A system, comprising:

a heat transfer unit, comprising:

an enclosure comprising an air intake and an air exhaust;

a heat exchanger disposed in the enclosure;

a plurality of louvers coupled to the air intake or the air exhaust;

at least one drive coupled to the plurality of louvers; and a controller coupled to the at least one drive, wherein the controller is configured to actuate the at least one drive to move the plurality of louvers from an open position to a closed position when the heat exchanger transitions from an active state to an inactive state.

18. The system of claim 17, wherein the plurality of louvers comprises a plurality of exhaust louvers coupled to the air exhaust, and wherein the controller is configured to actuate the at least one drive to move the plurality of exhaust louvers from a closed exhaust position to an open exhaust position when the heat exchanger transitions from the inactive state to the active state.

19. The system of claim 17, wherein the plurality of louvers comprises a plurality of intake louvers, and wherein the controller is configured to actuate the at least one drive to move the plurality of intake louvers from a closed intake position to an open intake position when the heat exchanger transitions from the inactive state to the active state.

20. The system of claim 17, wherein the heat exchanger comprises an air conditioning heat exchanger having a refrigerant path.

21. A system, comprising:

a heat transfer unit, comprising:

an enclosure comprising an air intake and an air exhaust;

a heat exchanger disposed in the enclosure;

a plurality of exhaust louvers coupled to the air exhaust;

at least one drive coupled to the plurality of exhaust louvers; and a controller coupled to the at least one drive, wherein the controller is configured to actuate the at least one drive to move the plurality of exhaust louvers from an open exhaust position to a closed exhaust position when the heat exchanger transitions from an active state to an inactive state.

22. The system of claim 21, comprising a plurality of intake louvers coupled to the air intake, wherein the controller is configured to actuate the at least one drive to move the plurality of intake louvers between an open intake position and an closed intake position when the heat exchanger transitions from an active state to an inactive state.

23. The system of claim 22, wherein the controller is configured to actuate the at least one drive to move the plurality of exhaust louvers from the closed exhaust position to the open exhaust position and to move the plurality of intake louvers from the closed intake position to the open intake position when the heat exchanger transitions from the inactive state to the active state.

* * * * *